US005540015A

United States Patent [19]

Anthony

[11] Patent Number: 5,540,015

[45] Date of Patent: Jul. 30, 1996

[54] PRECONSTRUCTED SOFFIT-FASCIA ASSEMBLY

[76] Inventor: John D. Anthony, 155 Mann Lot Rd., Scituate, Mass. 02066

[21] Appl. No.: 242,534

[22] Filed: May 13, 1994

[51] Int. Cl.[6] ..... F24F 7/02; E04D 13/17

[52] U.S. Cl. ..... 52/95; 52/94; 52/199; 52/302.1; 454/260

[58] Field of Search ..... 52/94, 95, 96, 52/198, 199, 302.1, 11; 454/260

[56] References Cited

U.S. PATENT DOCUMENTS

| | | | |
|---|---|---|---|
| 2,991,709 | 7/1961 | Haddix | 52/95 X |
| 3,098,322 | 7/1963 | Greene . | |
| 3,415,019 | 12/1968 | Andersen . | |
| 3,696,572 | 10/1972 | Jureit | 52/94 |
| 3,824,749 | 7/1974 | Scherf | 52/94 X |
| 3,826,048 | 7/1974 | Merkin et al. | 52/94 X |
| 4,189,878 | 2/1980 | Fitzgerald | 52/94 X |
| 4,300,319 | 11/1981 | Frost et al. | 52/94 X |
| 4,347,691 | 9/1982 | Lloyd-Jones . | |
| 4,461,128 | 7/1984 | Knoebl . | |
| 4,611,443 | 9/1986 | Jorgensen et al. | 52/95 |

OTHER PUBLICATIONS

*House and Home*, Dec. 1985, pp. 108–109.

*Primary Examiner*—Carl D. Friedman
*Assistant Examiner*—Kevin D. Wilkens
*Attorney, Agent, or Firm*—Hale and Dorr

[57] ABSTRACT

A preconstructed soffit and fascia unit in which the fascia is secured to the front of the soffit and the back of the soffit is secured to the front face of a side panel of a wall before the side panel is mounted on the wall studs. The soffit and fascia unit is strengthened with intermediate supports that extend across the channel formed by the fascia, soffit, and side panel. The preconstructed soffit and fascia unit permits the elimination of the rafter tails.

7 Claims, 2 Drawing Sheets

PRECONSTRUCTED SOFFIT-FASCIA ASSEMBLY

FIELD OF THE INVENTION

This invention relates to building structures and methods of construction and, more specifically, to the construction of a soffit-fascia assembly, and the installation of a soffit-fascia assembly onto a building.

BACKGROUND OF THE INVENTION

The installation of the fascia and soffit underneath the edges of the roof of a house or other building is expensive and time-consuming. On those sides of a building on which the roof extends beyond the end of the side, the fascia extends down from the underside of the roof. The soffit extends horizontally from the lower edge of the fascia to the side of the building.

The wall typically is made by attaching sheathing, or panels, to a frame made of studs, before the wall is raised. The walls are then raised and secured. After the roof is attached, the soffit and fascia are added.

The installation of separate soffit and fascia pieces requires considerable time and precise alignment of the pieces is difficult. The pieces must be attached to the roof, to the wall, and to each other from a position at the tops of the walls. Under these conditions, the pieces are difficult to maneuver and attach. Consequently, installation is also very expensive.

The soffit and fascia sometimes are combined into a single unit, often made of metal or plastic. However, while this reduces the number of separate steps required to install the soffit-fascia unit, it is still necessary to maneuver the unit to the correct location at the top of the wall and then to secure it.

It is therefore an object of the present invention to provide an improved method for installing the soffit and fascia.

It is another object of the present invention to provide an improved soffit and fascia assembly that is easily installed.

SUMMARY OF THE INVENTION

According to the present invention, these and other objects and advantages are achieved by nailing or otherwise securing a section of the soffit to a section of the fascia, and the soffit section to a side panel for the wall before the side panel is mounted on the wall studs. This soffit assembly may be completed before the pieces are delivered to the building site. The side panel portion of the soffit assembly is then nailed or otherwise secured to the studs. The fascia section, soffit section, and portion of the side panel closest to the top of the wall form a C-shaped channel while the wall is on the ground, which becomes a U-shaped channel once the wall is raised. After the wall is raised and the roof added, the fascia is easily secured to the roof by nails, staples, or other means.

In a preferred embodiment, the soffit assembly is secured to the wall studs before the wall is raised. However, the soffit assembly may be secured to the wall studs after the wall is raised.

In a preferred embodiment, each fascia section is made from 1"×8" pine boards and each soffit section is made from 1"×6" pine boards, with corresponding sections cut to the same standard sizes (such as 12', 14', or 16' lengths). Alternatively, finger-jointed pine boards in convenient lengths may be used. The side panel is made from wall sheathing, such as one-half inch plywood boards. In a preferred embodiment, the side panel is approximately the same length as the soffit and fascia sections, and approximately one foot wide. The side panel may consist of two (or more) one foot wide plywood boards positioned end to end which, when attached to the soffit, form a single side panel. Other sizes may be used for each of these pieces, as appropriate.

After each soffit assembly is secured to the wall studs, the adjoining ends of two fascia sections may be screwed to a block placed on the inside of the channel, to ensure proper alignment. Where the soffit will not continue around a corner of the building, the corresponding soffit and fascia sections may extend beyond the end of the side panel, to ensure that the soffit and fascia extends to the end of the completed wall. Where the soffit will continue around a corner of the building, the corresponding soffit and fascia sections may be mitered to permit the ends to align when the walls are raised. Alternatively, the soffit and fascia sections on one of the walls may be extended, and the end of the soffit assembly capped, so that when the walls are in place a continuous soffit is created.

Instead of wood, the soffit and fascia may be aluminum, galvanized steel, plastic, or other suitable materials, and may be preformed as a single piece. Molding or frieze boards may be attached to the soffit or fascia before the soffit assembly is attached to the wall studs.

The soffit assembly is positioned on the wall studs so that, when the wall is raised and the roof added, the fascia will contact the roof. Alternatively, the soffit assembly may be positioned so that a small venting gap will remain between the fascia and the roof. Or, venting holes may be left in the soffit. In a preferred embodiment, the venting gap or venting holes are covered with a screen to prevent insects or debris from entering the soffit assembly and the interior of the building.

For placement of the soffit assembly onto the wall studs, the proper vertical distance from the top of the fascia to the top of the top plate of the wall is easily determined from the dimensions of the soffit, fascia, side panel, and rafters, and the pitch of the roof. Once the soffit assembly is completed, positions for the fascia for different rafter dimensions and roof pitches can be calculated and provided with the soffit assembly. Thus, the same soffit assembly may be used with different roof pitches.

In a preferred embodiment, the soffit assembly is strengthened with one or more intermediate supports positioned within the channel formed by the fascia, soffit, and upper portion of the side panel. Preferably, the supports are centered sixteen inches apart. In a preferred embodiment, the intermediate supports are made from spruce boards positioned perpendicular to the length of the soffit assembly, and which extend the full height and width of the channel. Alternatively, the intermediate supports may extend only partially from the soffit to the open side of the channel.

The present invention permits the elimination of the rafter tails, which conventionally must be used to support the soffit and fascia. This reduces the cost and the weight of the rafters. For additional strength, strapping can be nailed from each intermediate support to a rafter. Alternatively, rafter tails may be used provided that sufficient openings are left in the side panel.

In preferred embodiments where rafter tails are eliminated, the soffit assembly may be positioned on the wall studs so that the side panel extends above the top plate at the top of the wall. In this manner, the side panel will serve as a stop for the rafters when they are mounted on the walls.

To ease the positioning of the soffit assembly onto the wall studs, where the side panel will extend above the top of the top plate, marks can be placed on the side panel that will align with the top of the top panel upon proper positioning for different roof pitches and rafter dimensions. Where the side plate will not extend above the top of the top plate, the marks can, for example, be arranged to be a specified number of inches below the top of the top plate upon proper positioning for different roof pitches and rafter dimensions.

The present invention also can be used to create a flared rake board at the top of a gable. The ends are cut at angles to permit the flared rake board to align with adjoining portions of the soffit and fascia.

DETAILED DESCRIPTION OF THE INVENTION

Figure 1:
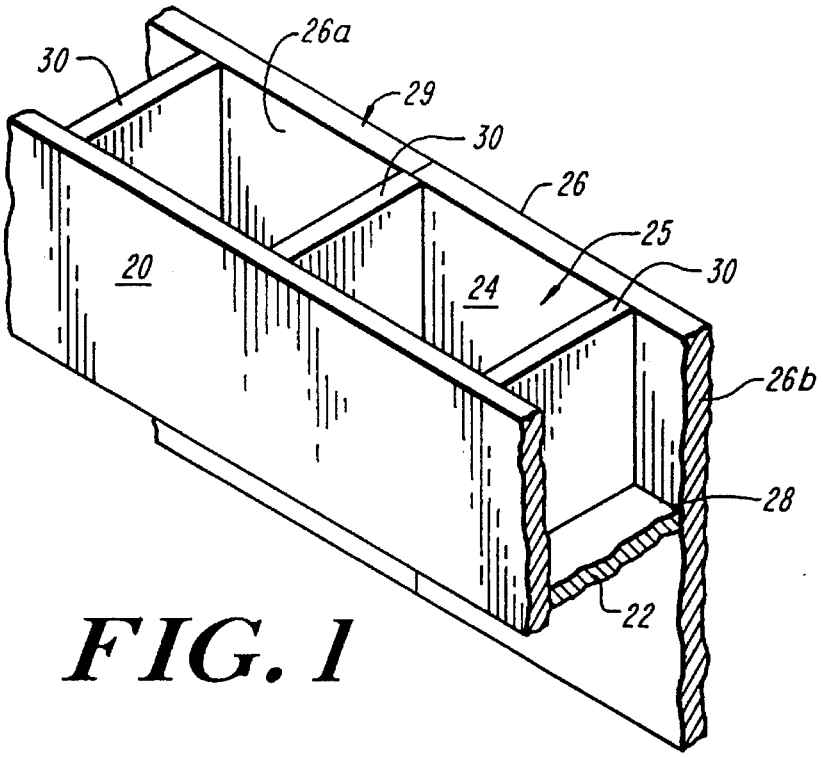
FIG. 1 is a perspective cutaway view of the soffit-fascia assembly of the present invention.

With reference to FIG. 1, a fascia section 20 made from a sixteen feet long piece of 1"×8" pine is nailed to the front end of a soffit section 22 made from a sixteen feet long piece of 1"×6" pine approximately at the bottom end of fascia section 20. Side panel 26 consists of two eight feet long by one foot wide pieces of plywood (26*a* and 26*b*) laid end to end. The back end of soffit section 22 is attached to the front face 24 of side panel 26 along line 28, to form soffit assembly 29. Thus, fascia section 20, soffit section 22, and the portion of side panel 26 above line 28 form a U-shaped channel 25 when the wall is vertical. The sides of fascia section 20, soffit section 22, and side panel 26 are aligned.

Intermediate supports 30 extend from soffit section 22 to the opening of the channel, and from fascia section 20 to side panel 26. Each intermediate support 30 is centered approximately sixteen inches apart, and is nailed to fascia section 20, soffit section 22, and side panel 26.

Figure 1A:
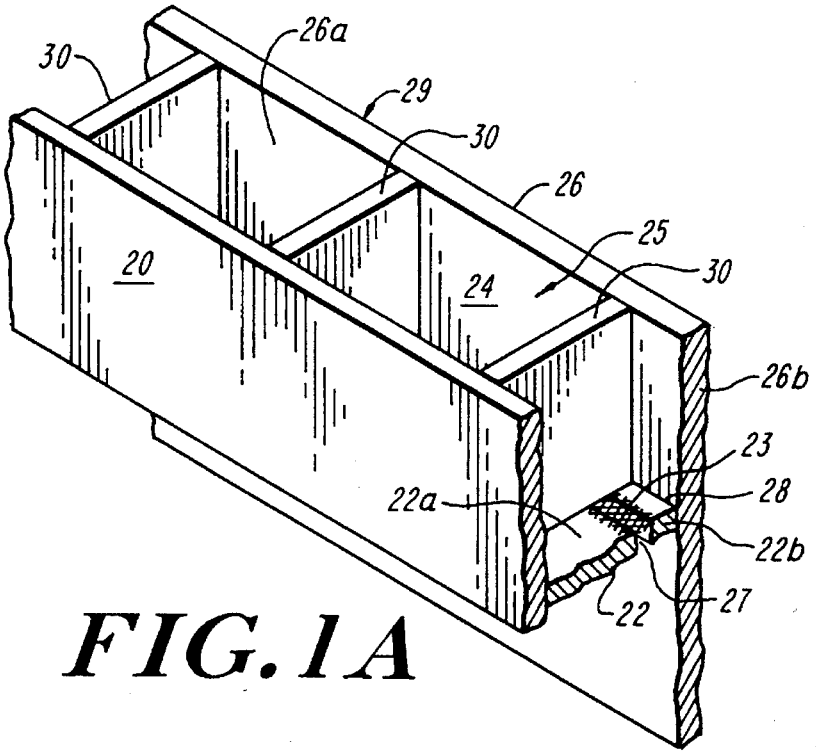
FIG. 1A is a perspective cutaway view of the soffit-fascia assembly shown in FIG. 1, showing a modified form of the present invention in which the soffit contains a venting gap.

Alternatively, soffit section 22 may be made from two approximately parallel pieces (22*a* and 22*b*), separated by a gap 23, to permit venting through the bottom of soffit assembly 29, as shown in FIG. 1A. In this embodiment, front soffit piece 22*a* is nailed to fascia section 20 and intermediate supports 30, and back soffit piece 22*b* is nailed to intermediate supports 30 and side panel 26. Gap 23 is covered with screen 27.

Figure 2:
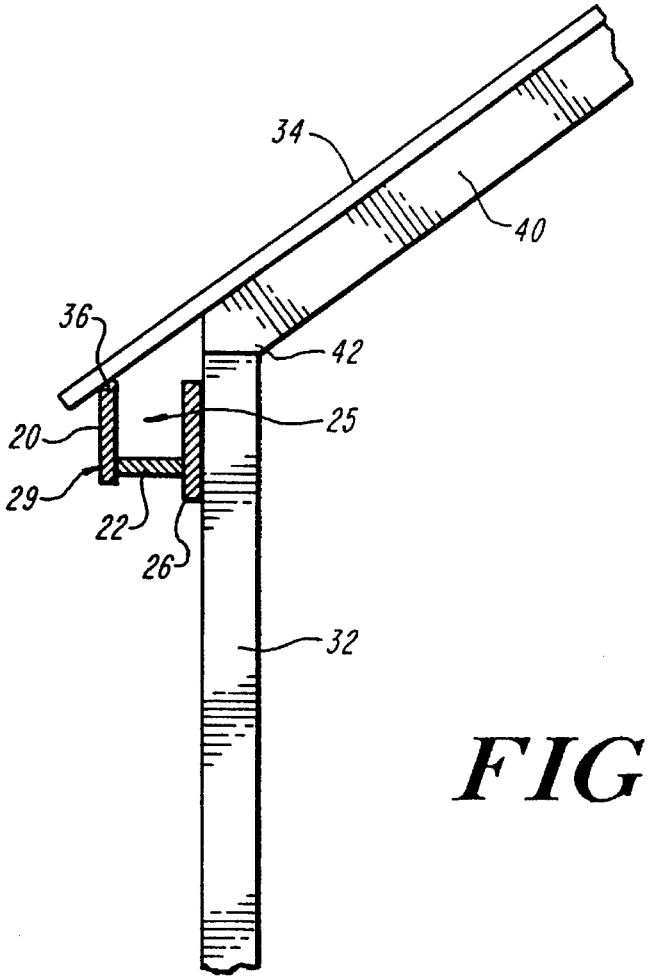
FIG. 2 is a sectional elevational view of a building, showing a section of a roof and a side wall, with the soffit-fascia assembly of the present invention attached.

After the fascia section 20, soffit section 22, side panel 26, and intermediate supports 30 are attached together, the resulting soffit assembly 29 is attached to wall 32 by nailing side panel 26 to the studs of wall 32 so that the top of fascia 20 will contact roof 34 along line 36, once the walls are raised and the roof attached (see FIG. 2).

Figure 3:
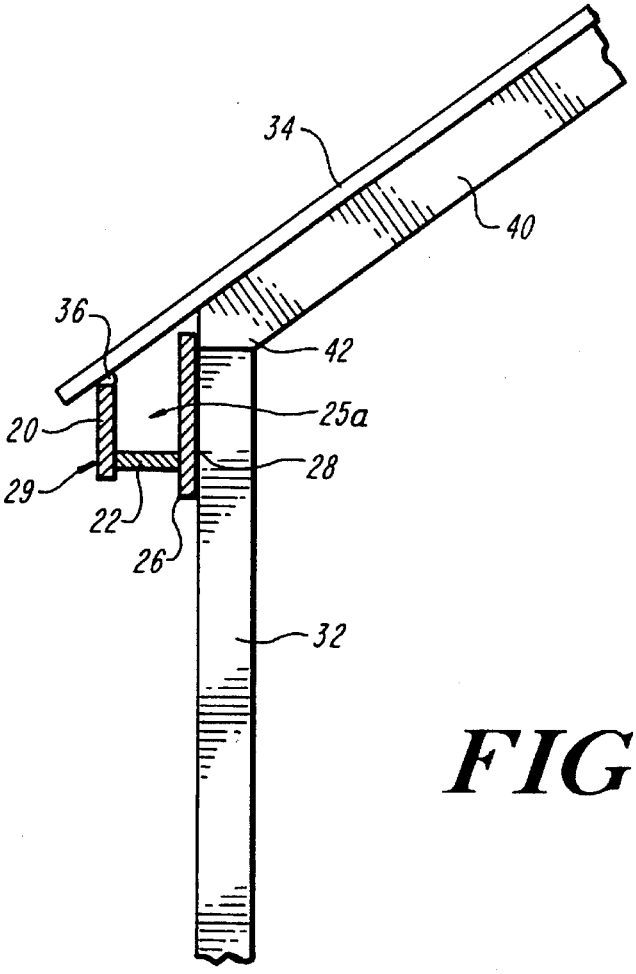
FIG. 3 is a sectional elevational view of the assembly shown in FIG. 2, showing a modified form of the present invention in which the side panel extends above the top plate of the wall.

As shown in FIG. 2, soffit 22 can be attached to side panel 26 so that the tops of fascia 20 and side panel 26 are at the same height. Alternatively, as shown in FIG. 3, because rafter 40 will extend only to wall 32, soffit 22 can be attached to side panel 26 so that when the top of fascia 20 contacts roof 34 along line 36, side panel 26 extends above the bottom 42 of rafter 40. In this manner, side panel 26 serves as a stop to rafter 40. Depending on the pitch of roof 34, this may require that the top of side panel 26 extend above the top of fascia 20. In such an embodiment, a J-shaped channel 25*a* is formed by fascia 20, soffit 22, and the portion of side panel 26 above line 28, as shown in FIG. 3.

This process is repeated until a complete soffit and fascia extends along wall 32. When a particular soffit assembly will extend to the end of wall 32, the sides of the fascia section and the soffit section may extend beyond the side of the side panel, so that the soffit and fascia will extend to the end of the finished wall.

After soffit assembly 29 is installed on wall 32, wall 32 is raised, and rafter 40 and roof 34 are attached. At this point, fascia 20 is nailed to roof 34 along line 36.

While there have been shown and described what at present are considered the preferred embodiments of the present invention, it will be obvious to those skilled in the art that various changes and modifications may be made therein without departing from the scope of the invention as defined by the appended claims.

What is claimed is:

1. A method for installing a soffit and a fascia onto a building comprising:

(a) securing a front end of the soffit approximately to a bottom end of the fascia;

(b) securing a back end of the soffit to a front face of a side panel;

(c) after steps (a) and (b), securing a back face of the side panel to a wall; and (d) after step (c), raising the wall.

2. A method for installing a soffit and fascia onto a building as defined in claim 1, wherein step (b) includes securing a back end of the soffit to a front face of a side panel so that a top end of the side panel extends to approximately the same height as a top end of the fascia.

3. A method for installing a soffit and fascia onto a building as defined in claim 1, further comprising the step of covering a venting gap in the soffit with a screen.

4. A method for installing a soffit and a fascia onto a building as defined in claim 1, wherein:

step (a) further comprises aligning a left side of the fascia approximately with a left side of the soffit and aligning a right side of the fascia approximately with a right side of the soffit; and step (b) further comprises aligning a side of the soffit with a side of the side panel.

5. A method for installing a soffit and a fascia onto a building as defined in claim 1, further comprising:

before step (c), securing an intermediate support to the fascia and to the front face of the side panel, above the soffit.

6. A method for installing a soffit and a fascia onto a building as defined in claim 1, further comprising:

before step (c), positioning the side panel along the wall so that a top end of the fascia will contact a roof when the roof is placed on the wall.

7. A method for installing a soffit and a fascia onto a building as defined in claim 6, wherein the positioning step further comprises positioning the side panel to extend above a top end of the wall.

* * * * *